United States Patent [19]

Rice

[11] 4,007,519

[45] Feb. 15, 1977

[54] INDICATING DEVICE FOR YARN CRIMPING WHEEL TEETH SPACING ADJUSTMENT

[75] Inventor: Charles M. Rice, Candler, N.C.

[73] Assignee: Akzona Incorporated, Asheville, N.C.

[22] Filed: July 11, 1975

[21] Appl. No.: 594,940

[52] U.S. Cl. ..... 28/1.8

[51] Int. Cl.[2] ..... D02G 1/14

[58] Field of Search ..... 28/1.8, 72.15

[56] References Cited

UNITED STATES PATENTS

| | | | |
|---|---|---|---|
| 2,044,135 | 6/1936 | Taylor | 28/72.15 X |
| 2,983,026 | 5/1961 | Skalko | 28/72.15 |
| 2,988,799 | 6/1961 | Atwell | 28/72.15 |
| 3,140,525 | 7/1964 | Lamb | 28/1.8 |

FOREIGN PATENTS OR APPLICATIONS

| | | | |
|---|---|---|---|
| 16,891 | 1912 | United Kingdom | 28/72.15 |

*Primary Examiner*—Robert R. Mackey
*Attorney, Agent, or Firm*—Francis W. Young; Tom R. Vestal

[57] ABSTRACT

In synthetic yarn texturing using crimping wheels, an indicating device is provided to aid in adjusting the peripheral spacing between the teeth of the wheels.

4 Claims, 4 Drawing Figures

INDICATING DEVICE FOR YARN CRIMPING WHEEL TEETH SPACING ADJUSTMENT

BACKGROUND OF THE INVENTION

In the use of continuous filament synthetic textile yarns, it has become increasingly important to overcome the smooth texture of the yarns as initially spun and to obtain an appearance more similar to the natural fibers such as cotton and wool, by a process of texturing or permanently distorting the filaments. Objectives of texturing are to achieve improved bulk, cover, warmth, crisp or soft hand, and, in some instances, to increase the elastic stretch of the filaments. A great variety of methods have been developed to texture the synthetic yarns, among which may be mentioned false twist texturing, knit-de-knit, steam stuffer box crimping, air jet texturing, and gear crimping using crimping wheels. This invention relates to the latter system.

Gear crimping of synthetic filaments consists of passing the filaments through wheels having intermeshing gear teeth which have sufficient peripheral spacing between the teeth to admit the filament without applying any pressure thereto. The crimping wheels may be, but are not necessarily, combined with other yarn processing apparatus such as drawing and twisting apparatus.

A principal difficulty in gear crimping lies in adjusting the spacing between the meshing teeth of the crimping wheels evenly in order to prevent damage to the filaments by pinching of the filaments between the wheels. Previous methods of adjusting the spacing have been tedious and cumbersome due to the fineness of the crimping teeth and the difficulty of making slight adjustments of a gear or crimping wheel on its shaft.

In my copending application Ser. No. 594,938 filed on even date herewith, an apparatus for adjusting the peripheral spacing between the teeth of yarn crimping wheels is described.

In accordance with the invention described therein, a pair of intermeshing gears fixedly attached on separate rotatable parallel shafts drive a pair of intermeshing crimping wheels also fixedly attached on the shafts. The gear and crimping wheel on each shaft are positioned so that rotation of the gear produces similar rotation of the crimping wheel. The number of teeth on each gear preferably is the same, as is the number of the teeth on each crimping wheel, although there usually are several times more crimping teeth than gear teeth. At least one drive shaft may be movable in order to disengage both the gears and crimping wheels.

The relationship between the tooth count of the gears and crimping wheels is such that when the gears and wheels are disengaged and one gear rotated a predetermined amount with respect to the other, reengaging the gears and wheels in the new position will result in a relatively small adjustment of the peripheral spacing between the teeth of the crimping wheels.

SUMMARY OF THE INVENTION

In accordance with this invention, a device with graduated markings, which may be about the size and general shape of the crimping wheel described above, is provided to be attached to one crimping wheel during adjustment of the spacing between adjacent teeth of meshing crimping wheels. Since the spacing adjustment is done by rotating one crimping wheel with respect to the other a distance equivalent to multiples of a calculated number of driving gear teeth, the device is marked with lines a corresponding distance apart. An index line is also marked directly on the other meshing crimping wheel. The device is provided with means for rotation with respect to the crimping wheel on which it is mounted for purposes of initial adjustment, and with means for fixedly attaching the device to the crimping wheel after the initial adjustment is made. Where N is the number of teeth in the driving gear for the crimping wheel, and where N is properly chosen as hereinafter described, a small adjustment of 1/N of the distance between crimping wheel teeth may be made by rotating one crimping wheel a predetermined amount with respect to the other and moving from one line marked on the graduated device to the next line. A convenient number of lines is marked on the device spaced predetermined distances apart.

BRIEF DESCRIPTION OF THE DRAWINGS

The invention will now be further described with reference to the appended drawings, in which.

DESCRIPTION OF THE INVENTION

Figure 1:
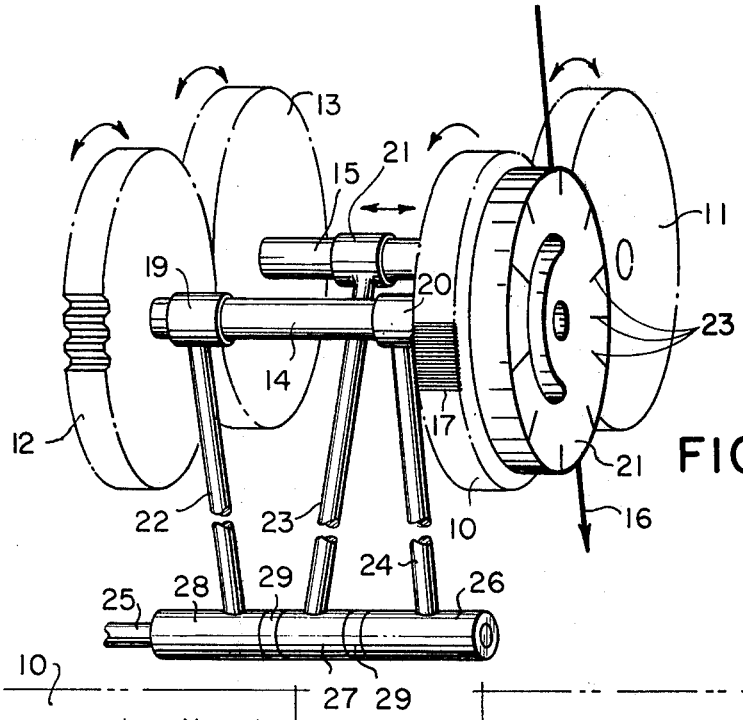
FIG. 1 is a perspective view of the driving gears, the driven crimping wheels associated therewith, and the graduated device.

In FIG. 1, the crimping wheels 10 and 11 and the gears 12 and 13 are shown, along with the indicating device 21. Crimping wheel 10 and driving gear 12 are fixedly mounted on a common shaft 14 which is driven from an external drive, not shown. Gear 12 meshes with and drives gear 13. Crimping wheel 11 and driving gear 13 are fixedly mounted on a common shaft 15. The shafts are supported by conventional bearing means. The teeth of crimping wheels 10 and 11 mesh but do not touch and this clearance permits passage of the yarn 16 to be crimped therebetween, as also shown in FIG. 3.

Shaft 14 is supported by bearing means and support rods 19 and 22 and 20 and 24, each in turn being attached to bearing housings 28 and 26. Bearing housings 28 and 26 are rotatably mounted on a pivot shaft 25 rigidly attached to a frame (not shown). Shaft 15 is supported by bearing means 21 and support rod 23, which in turn is connected to a bearing housing 27, also rotatably mounted on pivot shaft 25, and is spaced apart from the bearing housings 28 and 26 by spacers 29. When out of mesh, wheel 11 and gear 13 are held stationary while the wheel 10 and gear 12 are rotated a predetermined amount to a new position with respect to wheel 11 and gear 13. The indicating device 21 is attached to crimping wheel 10 as shown. At least one index line 22 (see FIG. 4) is marked on crimping wheel 11, and graduated lines 23 are marked at predetermined intervals on the indicating device.

Figure 2:
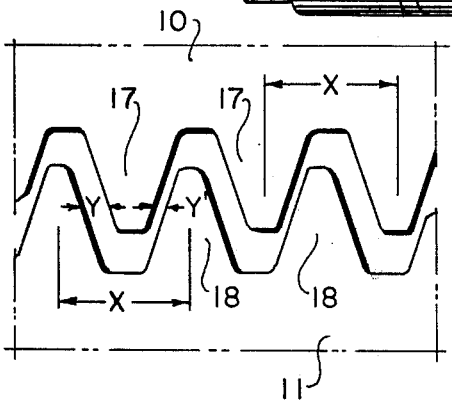
FIG. 2 is a magnified view of the meshing of the teeth on the crimping wheels when the spacing of the meshing teeth is uneven.

In FIG. 2, an illustration is given of the relationship between the teeth 17 and teeth 18 of meshing crimping wheels 10 and 11, respectively, when the crimping teeth are not evenly spaced. The distance between the center of any two adjacent teeth of either wheel (i.e., the circular pitch) is designated X. The peripheral spacing between the teeth 17 of one crimping wheel and the teeth 18 of the other crimping wheel on one side is represented by Y and on the other side Y′ (also see FIG. 3). Under normal conditions, the crimping wheels 10 and 11 should be adjusted so that Y and Y′ are as nearly equal as possible.

Figure 3:
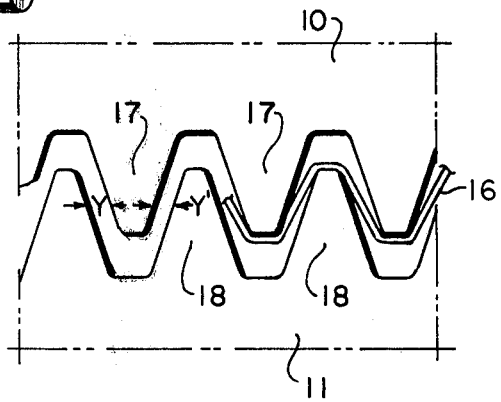
FIG. 3 is a view similar to FIG. 2 but showing even spacing of the meshing teeth.

In FIG. 3, an illustration is given of the relationship between the teeth 17 and teeth 18 of meshing crimping wheels 10 and 11 when the teeth 17 and 18 are evenly spaced, i.e., the distances Y and Y′ are equal. The position of the yarn 16 being crimped is also shown.

Referring to FIGS. 2 and 3, when the crimping wheel 10 with teeth 17 is rotated to a new position with respect to the crimping wheel 11 with teeth 18 in accordance with the invention herein, the peripheral distances Y and Y′ between the meshing crimping gear teeth will change, as will be described more fully hereinafter.

When the dividend D of the number of crimping wheel teeth divided by the number of driving gear teeth (i.e., the number of crimping wheel teeth per driving gear tooth) is an integer, the mesh of the crimping teeth will always be the same regardless of the rotational positioning of the driving gears relative thereto. For example, for crimping wheels of tooth count each of 300 and driving gears of 60 tooth count each, $D = 300 \div 60 = 5$; i.e., for each relative movement of one tooth between the driving gears, the crimping teeth will be displaced exactly five teeth, and the mesh spacing Y and Y′ or position of the crimping teeth of one wheel relative to the teeth of the other crimping wheel will remain the same.

When the dividend D of the number of crimping wheel teeth over the number of driving gear teeth is a combination of an integer and a fraction, however, the crimping teeth mesh spacing will vary upon relative repositioning of the driving gear teeth. For example, assume that the tooth count of the crimping wheel is 300 and the driving gear tooth count is 79. Then, $D = 300 \div 79 = 3\ 63/79$.

The dividend number D represents the number of crimping wheel teeth per driving gear tooth, that is, the relative rotational positioning of the teeth of the crimping wheels for a relative shift of one tooth between driving gears. This invention recognizes that minute adjustment of the position of the teeth on one crimping wheel relative to the teeth on the other crimping wheel can be made by the positioning of the gear teeth. From the above example having gearing of 79 teeth, it can be seen that a relative rotation of the gear equal to five gear teeth corresponds to a relative rotation of $5 \times 3\ 63/79$ or 18 78/79 crimping wheel teeth; e.g., the relative position of the crimping wheels has changed 19 teeth before remeshing and, also, the mesh spacing of the crimping wheel teeth has changed by $19 - (18\ 78/79)$ or 1/79 of the crimping wheel tooth spacing X.

Relative rotation of 10 driving gear teeth, therefore, represents a relative positioning of the crimping wheel teeth of $10 \times 3\ 63/79$ or 37 77/79; e.g., the mesh spacing of the crimping wheel teeth has changed by 2/79 of the crimping wheel tooth spacing X. Similarly, relative rotation of 15 driving gear teeth changes the mesh spacing 3/79 of the crimping wheel tooth spacing X; and, in general, for this particular ratio gearing, a relative rotation of 5N driving gear teeth changes the mesh spacing by N/79 (N being a whole number).

Figure 4:
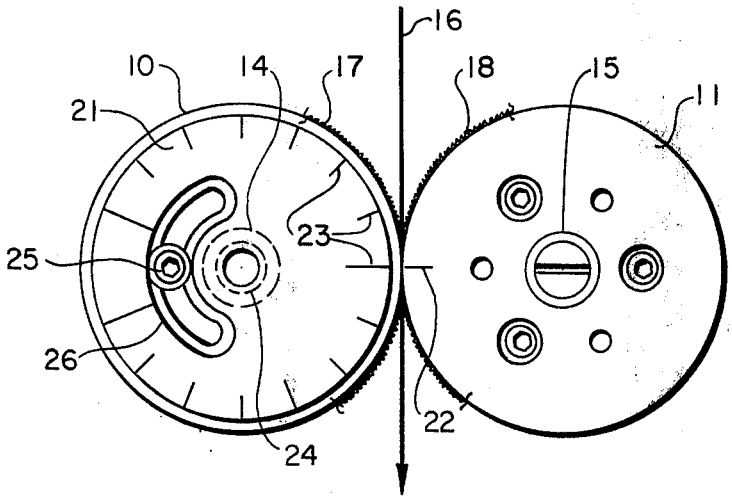
FIG. 4 is an end view of the crimping gears and the graduated device.

In FIG. 4, an end view illustration is given of one embodiment of this invention. The indicating device 21 is about the size and shape of the crimping wheel 10, except that the periphery of the device is smooth, with no gear teeth. The device 21 has a hub 24 in the center of the rear face for engagement with a matching recess in the center of shaft 14. The device 21 is fastened to the crimping wheel 10 by means of a screw or other fastener 25 in the arcuate slot 26. An initial adjustment may be made by aligning one of the lines 23 on the device with the index line 22 on the crimper wheel 11 by a limited rotation of the device 21 with respect to crimper wheel 10 around the hub 24 as a center. During this limited rotation, the arcuate slot 26 in which the fastener 25 is placed changes position in relation to the fastener 25. When the index line 22 on the crimping wheel 11 is aligned with one of the lines 23 on the device 21, the fastener 25 is tightened to hold the device 21 fixedly in position, attached to the crimping wheel 10.

The adjustment of the peripheral spacing between the teeth of the yarn crimping wheels 10 and 11 may then be done as follows. On observation of the spacing of the intermeshing teeth of yarn crimping wheels 10 and 11, if the teeth are not evenly spaced in relation to each other, the crimping wheel 11 is moved out of mesh with crimping wheel 10, and wheel 10 is rotated with respect to wheel 11 until the index line 22 on the wheel 11 is aligned with the next adjacent line 23. The crimping wheels 10 and 11 are then remeshed, and the teeth of wheels 10 and 11 will have moved in relation to each other by a small increment. As previously explained, this increment is typically equal to 1/N of the distance from one tooth to an adjacent tooth on a crimping wheel, where N is the number of teeth on a driving gear.

The increment movement is small enough so that the spacing between the crimping teeth may be satisfactorily adjusted by moving the crimping wheel 10 and the attached device 21 with respect to crimping wheel 11, matching successive lines 23 with index line 22 until the spacing between the crimping teeth is even.

What is claimed is:

1. An apparatus for crimping yarns comprising a first gear and a first crimping wheel, both fixedly attached to a first shaft; a second gear and a second crimping wheel, both fixedly attached to a second shaft; said first and second crimping wheels each having a determined number of teeth uniformly spaced around the periphery of the crimping wheel and said first and second gears each having another and different determined numbers of teeth uniformly spaced around the periphery of the gear; means for engaging and disengaging said first and second gears and said first and second crimping wheels; means to rotate said first gear; a device attached to said first crimping wheel to rotate in conjunction therewith; graduated markings on one face of the device corresponding to points along the periphery of said first crimping wheel; and an index mark on said second crimping wheel correlative to said graduated markings on said first crimping wheel, whereby the peripheral spacing between the teeth of said first crimping wheel and the teeth of said second crimping wheel, when engaged, can be changed by disengaging the gears and crimping wheels and rotating said first gear and first crimping wheel a predetermined amount with respect to said second gear and second crimping wheel in accordance with the alignment of the index mark and graduated markings and re-engaging the crimping wheels and gears.

2. The device of claim 1 further comprising means for rotatably attaching said device to said first crimping wheel for initial adjustment and for maintaining the adjustment of said device to said first crimping wheel.

3. The device of claim 1 wherein the graduated markings are radially spaced a distance apart equal to the distance along the periphery of the said first crimping wheel which is the said predetermined amount said first gear and said first crimping wheel are rotated with respect to said second gear and second crimping wheel in order to yield a minimum increment of adjustment.

4. The device of claim 1 wherein the graduated markings are spaced apart a distance equal to the circular pitch of five gear teeth of said first gear.

* * * * *